US005975087A

United States Patent [19]

Jang

[11] Patent Number: 5,975,087

[45] Date of Patent: Nov. 2, 1999

[54] ARTIFICIAL NAIL OVERLAY AND METHOD OF PRINTING THE OVERLAY

[75] Inventor: Sung Yong Jang, Roslyn Heights, N.Y.

[73] Assignees: Sung Yong Chang; Terry Kim; Jun Hee Lee; part interest to each

[21] Appl. No.: 09/137,678

[22] Filed: Aug. 21, 1998

[30] Foreign Application Priority Data

Apr. 10, 1998 [KR] Rep. of Korea ..... 98-12763

[51] Int. Cl.[6] ..... A45D 29/00; A45D 29/18

[52] U.S. Cl. ..... 132/73; 132/73.5; 132/285

[58] Field of Search ..... 132/73, 73.5, 285

[56] References Cited

U.S. PATENT DOCUMENTS

| | | | |
|---|---|---|---|
| 4,177,750 | 12/1979 | Scarlet | 116/173 |
| 4,536,426 | 8/1985 | Massey | 132/73 |
| 4,903,840 | 2/1990 | So | 132/73 |
| 4,913,173 | 4/1990 | Hokama et al. | 132/73 |
| 4,974,610 | 12/1990 | Orsini | 132/73 |
| 5,525,389 | 6/1996 | Hoffmann et al. | 132/73 |
| 5,724,999 | 3/1998 | Kim | 132/200 |
| 5,770,184 | 6/1998 | Keller | 424/61 |
| 5,778,900 | 7/1998 | Bate | 132/73 |

*Primary Examiner*—John J. Wilson
*Assistant Examiner*—Robyn Doan
*Attorney, Agent, or Firm*—Burns, Doane, Swecker & Mathis, L.L.P.

[57] ABSTRACT

An artificial nail overlay on which a predetermined picture or pattern has been pre-printed. The overlay is flattened to be dyed or printed so that it provides advantage of removing the separate designing work on silk fabrics during the attaching process of the artificial nail to a natural nail.

5 Claims, 6 Drawing Sheets

ARTIFICIAL NAIL OVERLAY AND METHOD OF PRINTING THE OVERLAY

BACKGROUND OF THE INVENTION

1. Field of the Invention

The present invention relates generally to a nail ornament. In particular, the present invention relates to an artificial nail overlay for providing a nail design as well as for improving adherence and durability of artificial nails. The present invention also relates to a method of dying and printing the artificial nail overlay.

2. Description of the Prior Art

The term "overlay" employed in the present application means a strip, preferably a fabric type, attached to an upper portion of a natural and artificial nail for improving adherence and durability of the artificial nail attached to the natural nail. U.S. Pat. No. 4,536,426 issued on Aug. 20, 1985 to Massey discloses such an example, which was referred to in the present application.

Attention has been paid on nails as part of a human body according to the development of cosmetic industry in modern society. Long nails colored brightly with special care are recognized as an essential element of cosmetology which enhances femininity and beauty. Accordingly, modern women tend to spend more time for beautifying their own nails. However, it is practically difficult for most of the working women to grow their nails long. Long nails are apt to be broken and difficult to take care of.

One solution that can replace the long natural nails is utilizing artificial nails covering the entire portion of natural nails, or cosmetic ornaments, i.e., tips attached to upper end portions of artificial nails.

It is well known in the art to attach plastic strips or artificial nails having shapes and sizes similar to those of the long natural nails to lower portions of the natural nails to increase the length of the natural nails for cosmetic purposes. Conventionally, such a disguise takes a form of using sheets or strips composed of injection-molded plastic materials attached to lower portions of the natural nails on which an adhesive comprising ethyl-cyanoaclates, etc. is applied. Such sheets or strips are manufactured for commercial purposes to have diverse widths of 6 to 13 kinds to conform with different widths of natural nails and to have a predetermined curvature so that the concave faces of their lower portions extending the finger lines match with the convex faces of the upper portions of the natural nails. Extended tips of the artificial nails can range from 0.76 cm to 3.81 cm, and their hems are curved to conform with the curvatures of the growing natural nails.

Attachment of artificial nails are generally performed by professional manicurists. As illustrated in FIG. 1, a plastic artificial nail 4 having a shape of an ordinary human nail is attached to the lower portion of the natural nail on which an adhesive is to be applied. The artificial nail is longitudinally extended from that position to have a predetermined length. The extended artificial nail is cut by a nail cutter to have a tip of predetermined length. The surface and hem of the plastic strip are smoothed by a file or a buffer.

The artificial nail described above is composed of plastic resin to have elasticity. If its tip is too long, however, the artificial nail is apt to be broken or separated from the natural nail.

To overcome this drawback, overlays such as silk strips, linen strips or glass fabric strips are attached to upper portions of artificial nails. FIG. 2 shows a process of providing an overlay.

Referring to FIG. 2, an overlay 6 is placed to cover a natural and artificial nail. An adhesive 8 is sufficiently applied on the upper portion of the overlay 6 for its full adhesion to the nail. Once the adhesive 8 is hardened, the spare portion of the overlay 6 is cut by a scissor. If necessary, an overlay may be attached to the nail after being cut in a predetermined shape. The nail is once again smoothed by a file, etc. Attachment of the artificial nail is finalized by coating a polish manicure of an acrylic component on the smoothed nail.

Pictures or patterns are often drawn on the surface of an overlay to diversify or beautify an artificial nail attached to a natural nail.

FIG. 3 shows a method of drawing pictures or patterns on the surface of an overlay by a manicurist with a brush or a stick by utilizing ink, paint, manicure or shining materials, etc. for the client who wishes decoration thereon. This method, however, has a drawback of requiring a special treatment by a manicurist which incurs an expense because the user cannot easily draw pictures on her own nails.

As described above, the process of attaching an artificial nail to a lower portion of a natural nail is quite time-consuming. Particularly, printing a design on a nail for additional beautification incurs an additional time and expense.

Further, the coated French manicure is peeled off after a certain period of time, e.g., after 3 or 4 days, thereby requiring repeated coatings.

To resolve the above-described problem, a method was conceived, in which the user can design desired pictures or patterns on her own nails, as shown in FIGS. 4 and 5. FIG. 4 illustrates a method of attaching a pre-patterned sticker 10 to a nail. FIGS. 5A and 5B illustrate a method of transferring a picture on the surface of a nail by utilizing a water decal paper 12. According to this method, one of the water decalling papers, on which a predetermined picture or pattern is printed, is separated from the others by means of water, and is placed on a nail to be coated by transparent manicure. Nail decorations utilizing such water decal papers not only saves labor, time and cost but also have an advantage of expressing subtlety, which cannot be expressed by direct drawings on the nail, or pictures of original colors such as photographs.

FIGS. 6A and 6B illustrate a so-called "French manicure," a method of manicuring in white color an end portion of a nail and manicuring the entire nail with light pink color.

SUMMARY OF THE INVENTION

An object of the present invention is to resolve the above problems, and to provide an artificial nail overlay which can reduce time and expense for designing pictures, etc. on the surface of an artificial nail overlay.

Another object of the present invention is to provide an artificial nail overlay which can allow structural solidity as well as beauty to attached artificial nails.

Still another object of the present invention is to provide a method of dying and printing an artificial nail overlay.

In one aspect of the present invention, there is provided an artificial nail overlay attached to an upper portion of a natural nail for reinforcing solidity of the artificial nail attached to the natural nail, the artificial nail overlay comprising a fabric strip, an adhesive coated on one surface of the fabric strip, a predetermined picture or pattern being dyed or printed on the other surface of the fabric strip, and a paper detachably attached to the surface of the fabric strip on which the adhesive has been coated.

According to an embodiment of the present invention, the fabric strip for reinforcing the artificial nail is printed by an offset printing.

The paper is preferably silicon-processed so that it can be detachably attached to the fabric strip. The fabric strip may be cut by a press in a desired shape after the paper is attached thereto.

The overlay is composed of a material selected from the group consisting of silk, cotton, fiber glass, nylon, polyester, knit fabrics, linen, rayon and wool. Silk is most preferable.

In another aspect of the present invention, there is provided a method of dyeing an artificial nail overlay used for reinforcing an artificial nail attached to a natural nail, comprising the steps of coating an adhesive on one surface of the overlay, attaching a paper to the surface of the overlay on which the adhesive has been coated, and dyeing the other surface of the overlay opposed to that on which the paper has been attached.

In still another aspect of the present invention, there is provided a method of printing an artificial nail/overlay used for reinforcing an artificial nail attached to a natural nail, comprising the steps of coating an adhesive on one surface of the overlay, attaching a paper on the surface of the overlay on which the adhesive has been coated, and printing the other surface of the overlay opposed to that on which the paper has been attached.

In the embodiment of the present invention, the printing is performed as an offset printing.

BRIEF DESCRIPTION OF THE DRAWINGS

The above objects, other features and advantages of the present invention will become more apparent by describing the preferred embodiments thereof with reference to the accompanying drawings, in which.

DETAILED DESCRIPTION OF THE PREFERRED EMBODIMENTS

Figure 1:
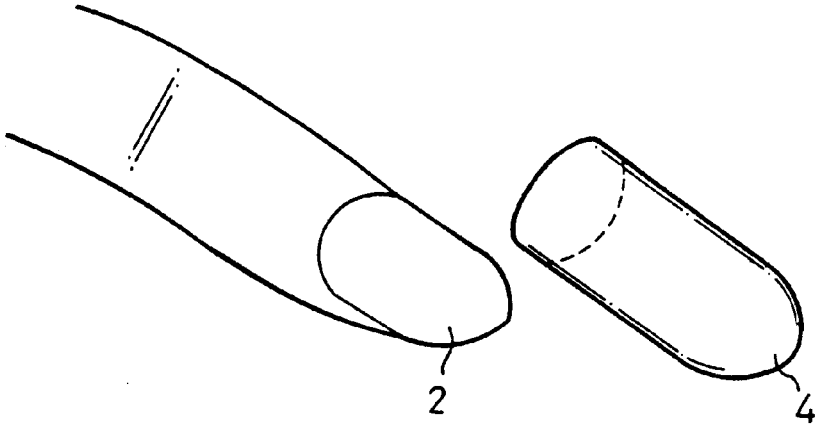
FIG. 1 (PRIOR ART)
FIG. 1 is a view briefly illustrating a natural nail and an artificial nail.
Figure 2:
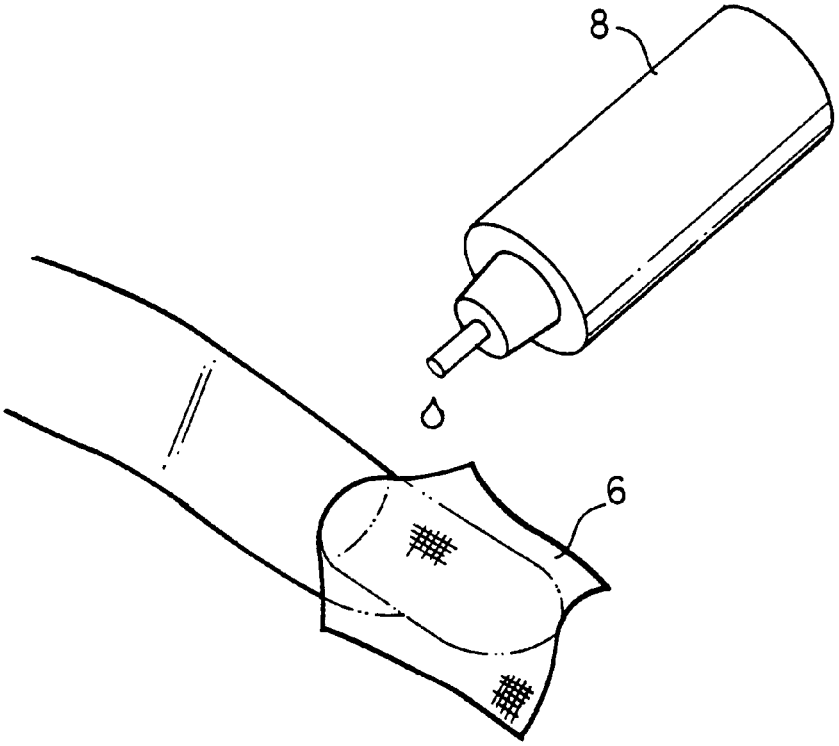
FIG. 2 (PRIOR ART)
FIG. 2 is a view illustrating the conventional overlay attached to a nail.
Figure 3:
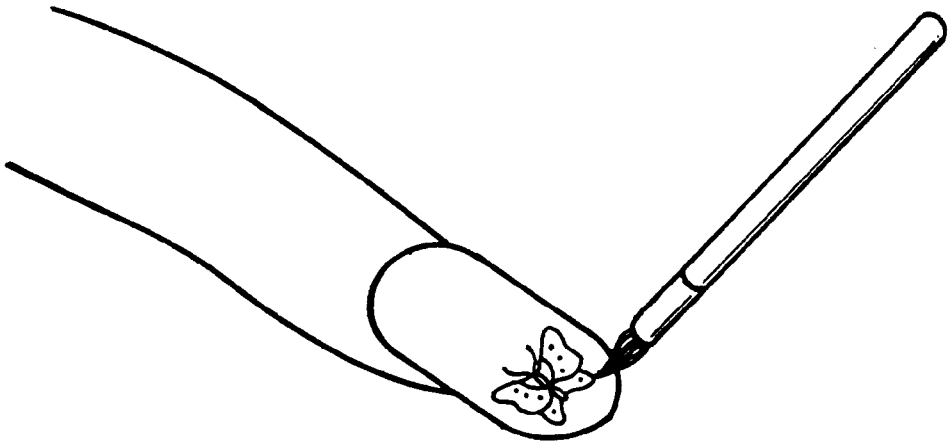
FIG. 3 (PRIOR ART)
FIG. 3 is a view illustrating a direct drawing of a picture or a pattern on the surface of an artificial nail.
Figure 4:
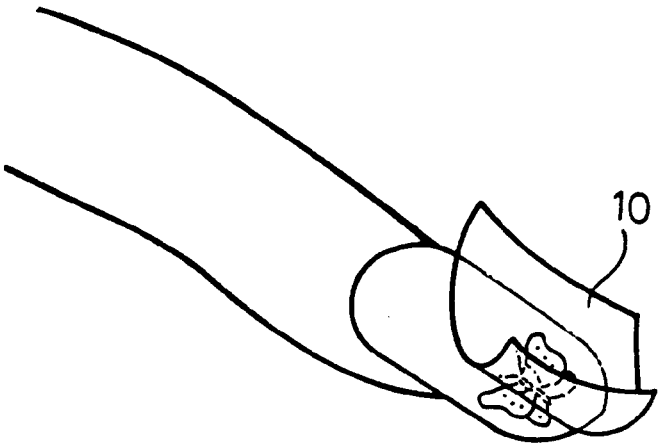
FIG. 4 (PRIOR ART)
FIG. 4 is a view illustrating a picture-printed sticker attached to an artificial nail.
Figure 5A:
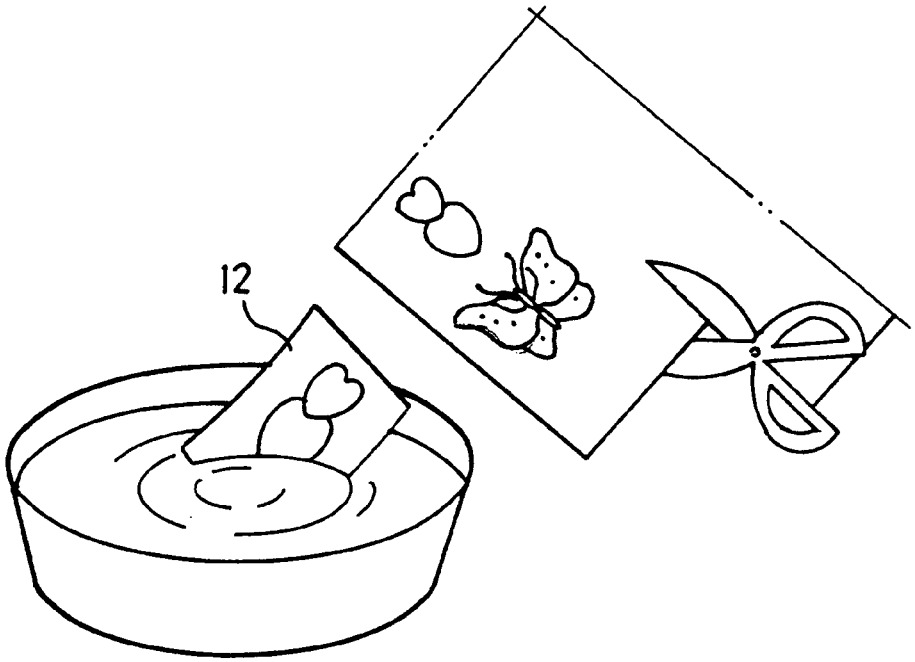
FIG. 5A (PRIOR ART)
FIGS. 5A and 5B are views illustrating pictures water-decalled on the surface of an artificial nail.
Figure 5B:
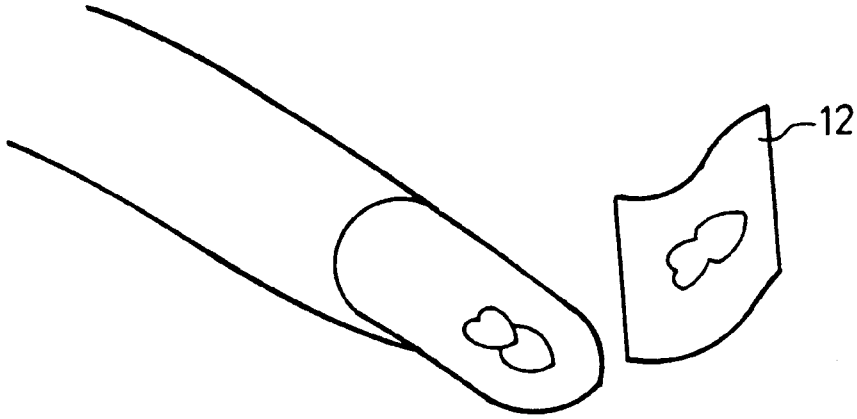
FIG. 5B (PRIOR ART)
Figure 6A:
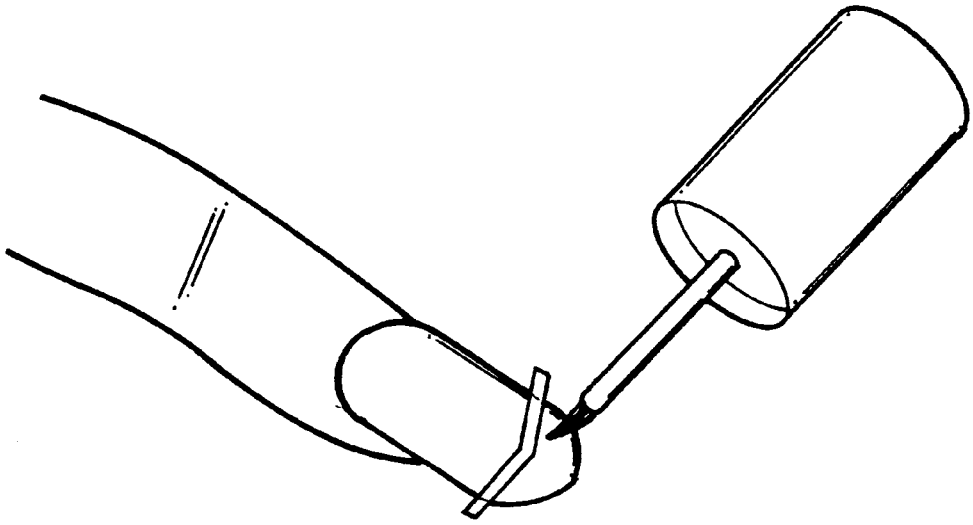
FIG. 6A (PRIOR ART)
FIGS. 6A and 6B are views illustrating manicuring of a lower portion of a nail with white color and manicuring of the entire nail with light pink color.
Figure 6B:
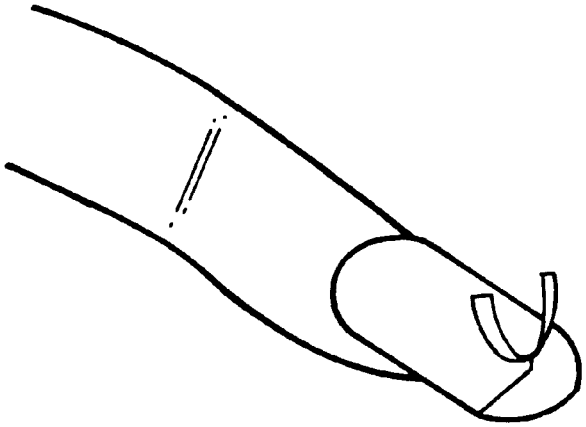
FIG. 6B (PRIOR ART)

Since silk is the most preferable material for an artificial nail overlay, a method of silk printing will now be explained according to the embodiment of the present invention. Silk fabrics may be printed by utilizing a vapor decal printing method.

The vapor decal printing method is a method in which silk fabrics is dyed by heating spread (vaporizing) dyes that is vaporized, and attaching the vaporized dyes to an object that will be vapor-decalled. This method, which was originally developed for textile printing, uses ink as a main component of spread dyes, and utilizes the reverse surface for printing with screen printing, offset printing, Gravier printing, rotary screen printing, etc. According to this method, a vellum paper of 150 g is printed and dried. An object to be decalled, i.e., silk fabrics, is pressed on the printed surface for 5 to 7 seconds under the temperature range of 200°–220° C. The spread dyes is then vaporized and fixed on the object to be decalled. The vaporizing dyes is vaporized, and fixed on the object to be decalled.

However, the vapor decal printing method described above has a drawback in that it results in coarse and imprecise printing.

According to the embodiment of the present invention, an artificial nail overlay is printed by employing an offset printing method, which is used for printing paper.

In the offset printing method utilizing a repelling power between water and oil, a pattern to be printed is manufactured as a film. The film is then closely contacted with a plate which has been processed with a sensitizing liquid. A minor-etching plate is prepared by sensitizing and etching the closely contacted film. Subsequently, ink is evenly applied thereon by an ink container which rotates adjacent to the minor-etching plate. The ink on the minor-etching plate is subsequently evenly applied on a rubber blanket rotating adjacent thereto. At this time, ink is spread on a paper placed between the rubber blanket and the pressing blanket.

Papers for a flat plate must be used in the offset printing method described above. Accordingly, the present invention provides flattening the silk fabrics. An adhesive is first applied on one surface of the silk fabrics, and a peel-off member such as silicon-processed paper is detachably attached on said surface, and is cut to be suited for printing. The silk fabrics alone may be cut by a press in a desired shape.

This method is more effective than the printing methods of dyeing, silk printing, or heat-decalling due to the automatic sheet feeding system of the offset machine. Also, the offset color printing is processed in four colors, thereby reducing tones of distinctive colors. Moreover, the present invention can fully express original colors of the pictures (e.g., photographs of original colors) that cannot be expressed by the conventional printing method.

The overlay with cut silk strip alone can be retained on an appropriate place due to the adhesive provided on the beneath surface of the overlay once it is separated from the paper and placed on upper potions of the nails by a manicurist. Accordingly, the overlay is not detached from the nails while applying an adhesive thereon.

Figure 7A:
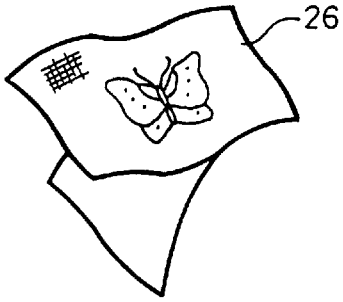
FIGS. 7A and 7B are views illustrating an overlay attached to an artificial nail according to the present invention.
Figure 7B:
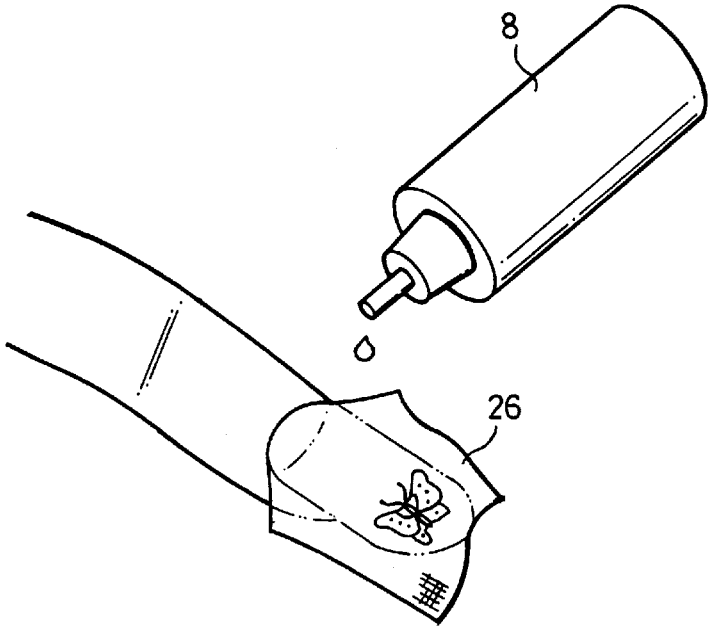

A predetermined picture or a pattern can be printed on the artificial nail overlay according to the method described above, as shown in FIGS. 7A and 7B. Employing a pre-printed fabric strip does not require the step for designing under the conventional method.

Figure 8:
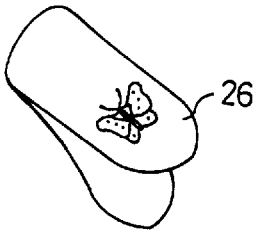
FIG. 8 is a view illustrating an overlay with its peel-off member being separated therefrom.
Figure 9:
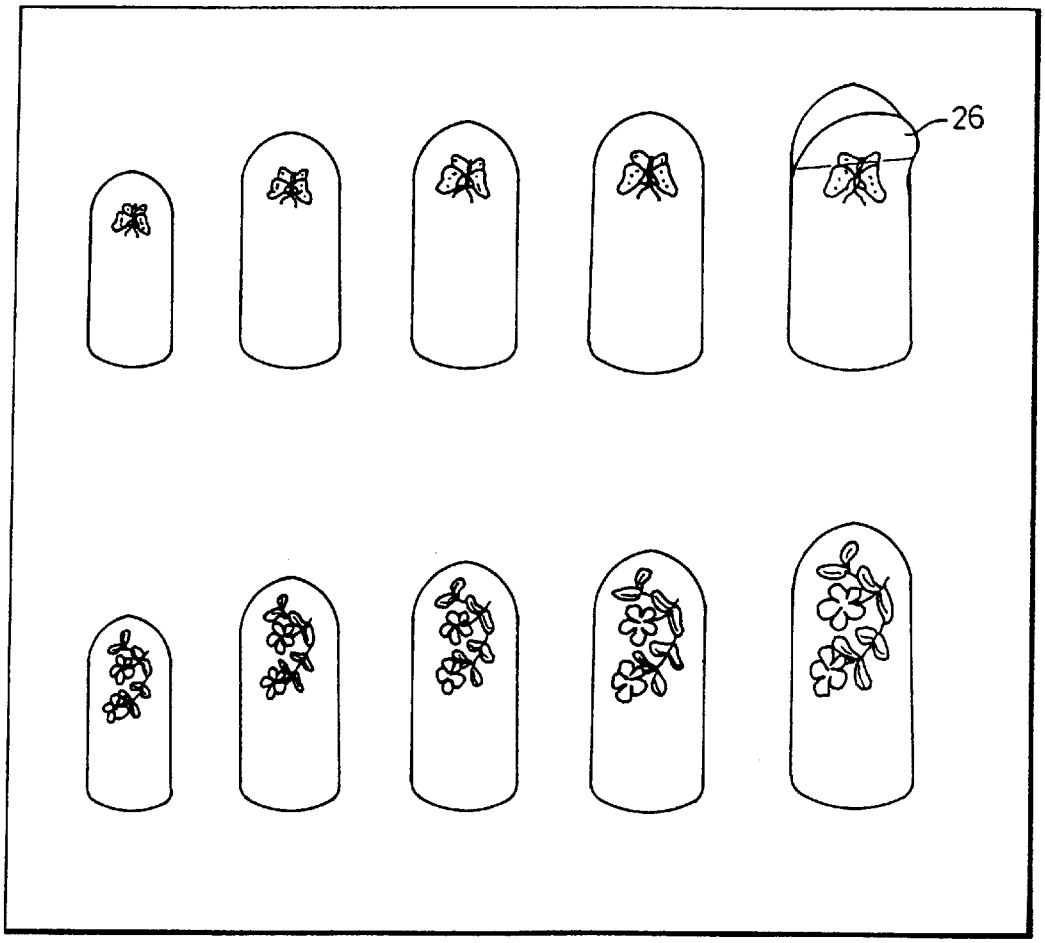
FIG. 9 is a view illustrating overlays which can be separately detached from their peel-off member according to another embodiment of the present invention.

In the embodiments of the present invention, a plastic artificial nail in the general shape of a human nail is attached to a lower portion of a natural nail on which an adhesive has been applied after the peel-off member is detached from the silk fabrics as shown in FIG. 8. A spare portion of the artificial nail longitudinally extending the natural nail is cut by a nail cutter. The surface and end hem of the plastic nail are smoothed by a file or a buffer. A silk strip 26 is placed on an upper portion of a natural and artificial nail. To attach the silk strip 26 to the nail, an adhesive 8 is sufficiently applied on the upper portion of the nail. After the applied adhesive has been hardened, the spare portion of the silk strip is cut by scissors. If necessary, the silk strip may be attached to the nail after being cut in a predetermined shape as shown in FIG. 9. The surface of the nail is smoothed by a file, etc. Attachment of an artificial nail is finalized by coating a polishing manicure of acrylic component on the smoothed nail.

According to the method of the present invention as described above, an artificial nail is attached by using a fabric strip on which a picture or a pattern has been pre-printed by an offset printing. Thus, the present invention simplifies the designing process and thereby saves time required for taking an additional step of designing after attaching an overlay to a nail as required under the conventional method.

The artificial nail overlay according to the present invention also utilizes an automatic supply system to improve productivity. Moreover, it can fully represent colors such as photographs of original colors which could not be expressed by the conventional printing method.

What is claimed is:

1. An artificial nail overlay attachable to a natural nail for reinforcing solidity of the artificial nail attached to the natural nail, the artificial nail overlay comprising:

a fabric strip;

an adhesive coated on one surface of the fabric strip;

a peel-off member detachably attached to the surface on which the adhesive has been coated to provide the fabric strip with flatness; and a predetermined picture or pattern offset-printed directly on the other surface of the fabric strip.

2. The artificial nail overlay according to claim 1, wherein the peel-off member is a silicon-processed paper so as to be detachably attached to the fabric strip.

3. The artificial nail overlay according to claim 3, wherein the overlay is cut by a press after the peel-off member is attached thereto.

4. The artificial nail overlay according to claim 1, wherein the fabric strip includes one or more material from silk, fiber glass, cotton, nylon, polyester, knit fabrics, linen, rayon, and wool.

5. A method of printing an artificial nail overlay, comprising the steps of:

coating an adhesive on one surface of a silk strip;

attaching a paper to the surface of the silk strip on which the adhesive has been coated, the paper being detachable as a peel-off member; and offset-printing a predetermined picture or pattern directly on the other surface of the silk strip.

* * * * *

UNITED STATES PATENT AND TRADEMARK OFFICE

CERTIFICATE OF CORRECTION

PATENT NO. : 5,975,087
APPLICATION NO. : 09/137678
DATED : November 2, 1999
INVENTOR(S) : Jang It is certified that error appears in the above-identified patent and that said Letters Patent is hereby corrected as shown below:

ON THE TITLE PAGE

Item (75) should read --(75) Inventor: Sung Yong Chang, Roslyn Heights, N.Y.--

Signed and Sealed this

Twentieth Day of January, 2009

JON W. DUDAS
*Director of the United States Patent and Trademark Office*